United States Patent [19]

Slavsky, Sr.

[11] Patent Number: 4,882,862

[45] Date of Patent: Nov. 28, 1989

[54] CLIP FOR MOUNTING PRICE CARDS UPON CONTAINER EDGES

[75] Inventor: Robert J. Slavsky, Sr., Lathrup Village, Mich.

[73] Assignee: Shaw & Slavsky, Inc., Detroit, Mich.

[21] Appl. No.: 143,723

[22] Filed: Jan. 14, 1988

[51] Int. Cl.[4] ..... G09F 3/00

[52] U.S. Cl. ..... 40/324; 40/658; 40/642

[58] Field of Search ..... 40/324

[56] References Cited

U.S. PATENT DOCUMENTS

| | | | |
|---|---|---|---|
| 2,040,750 | 5/1936 | Long | 40/324 |
| 2,717,463 | 9/1955 | Sindler | 40/324 |
| 2,779,114 | 1/1957 | Orthwine | 40/658 |
| 4,044,485 | 8/1977 | Hopp | 40/324 |
| 4,075,773 | 2/1978 | Daster | 40/658 |

*Primary Examiner*—Kenneth J. Dorner
*Assistant Examiner*—Venceslao J. Contreras
*Attorney, Agent, or Firm*—Harness, Dickey & Pierce

[57] ABSTRACT

A clip for mounting supermarket type price display cards upon different shaped edges of walls of open top containers is formed of a base with integral, downwardly extending legs forming an edge receiving channel and a number of integral upwardly extending legs for forming a series of card receiving channels upon the top of the base. The card receiving channels are arranged at different angles relative to the base for holding the cards in different, upright, tilted positions. One of the downwardly extending legs is about perpendicular to the base and terminates in a flange. The other downwardly extending leg extends downwardly a short distance, then exceeds horizontally towards the perpendicular leg and then is turned downwardly along a bowed curved aligned with the flange. Thus, different shaped container edges may be closely fitted between the straight and multiple bent legs and clamped between these legs.

14 Claims, 1 Drawing Sheet

CLIP FOR MOUNTING PRICE CARDS UPON CONTAINER EDGES

BACKGROUND OF THE INVENTION

In supermarkets and other retail type food stores, it is common to display certain articles of food in open top containers, such as bowls or pans and the like. For example, at the delicatessen counter, various kinds of salads may be displayed in open top bowls or shallow pans.

In order to display the price of the goods and other relevant information, it is common to use price display tags or cards which are mounted or positioned in some way at the particular food item displayed. In some instances, the card has been provided with wire supports which may be inserted into the food to hold the card upright above the food. At other times, the price display cards have been merely leaned against the container or in other ways attached thereto.

Because devices which mount the cards directly in the food, such as wire supports are unsanitary, these are prohibited in many areas and are likely to be prohibited in all areas in the future. Likewise, any other type mounting which contacts the food is or is likely to be prohibited in the future in order to maintain sanitary conditions in a retail store food display.

Different ways of mounting cards around or upon the bowl or container have not been satisfactory. No method currently is available which firmly attaches the card to the container, without contacting the food, and which cannot be knocked off the container easily or easily damaged. Obviously, merely leaning a price tag against the container is unsatisfactory because the card tends to move or to fall down when the container is moved.

Thus, there has been a need for a mounting means which can be readily used in a market for mounting a card upon the various types of containers that are commonly used in a display. Since the container and the container edges vary so much, depending upon the type of container, a single type of mounting device which is adaptable to the different types of container wall edges is desirable. This invention relates to a resilient clip formed of molded plastic which has a universal applicability to almost every type of open top container commonly used in retail store and supermarket food displays.

SUMMARY OF THE INVENTION

The invention herein contemplates a resilient plastic, molded clip which is formed with a base having a number of upwardly opening channels formed on its upper surface for receiving and holding price display cards at different angles. A downwardly opening channel is formed by a pair of integral legs extending downwardly from the base. The downwardly opening channel is formed of two different style legs, one being a straight or perpendicularly extending leg terminating in a flange. The other leg is a bent leg which is bent downwardly and then towards the straight leg and then in a downwardly directed curve along side of the leg. Thus, the downwardly opening channel is shaped to receive a variety of shaped wall edges of open top containers, including containers which have lips, straight upper edges without lips, etc.

The invention contemplates a clip which may be mounted upon the upper edge of a container, regardless of the shape of the edge, and wherein the user may selectively insert the price display card in one or another of the upper channels so that the card is angled or tilted in a direction which makes it most visible. In addition, the clip legs are formed so as to either eliminate or minimize contact with food contained in the container.

One object of this invention is to provide a simple, inexpensive plastic molded clip which can be universally used on almost all types of open top, food display, containers and which will hold the price display card at the most effective angle desired, depending upon the type of container and the location of the container.

Another object of this invention is to provide a sanitary, easily cleaned, clip for displaying price markers and similar indicia bearing cards in multiple positions on a food display.

Still another object of this invention is to provide a resilient clip which may easily be manually applied upon the upper edge of an open top food container and which will rigidly grip the container to remain in place until manually pulled off with substantial force.

These and other objects and advantages of this invention will become apparent upon reading the following description of which the attached drawings form a part.

DETAILED DESCRIPTION

Figure 1:
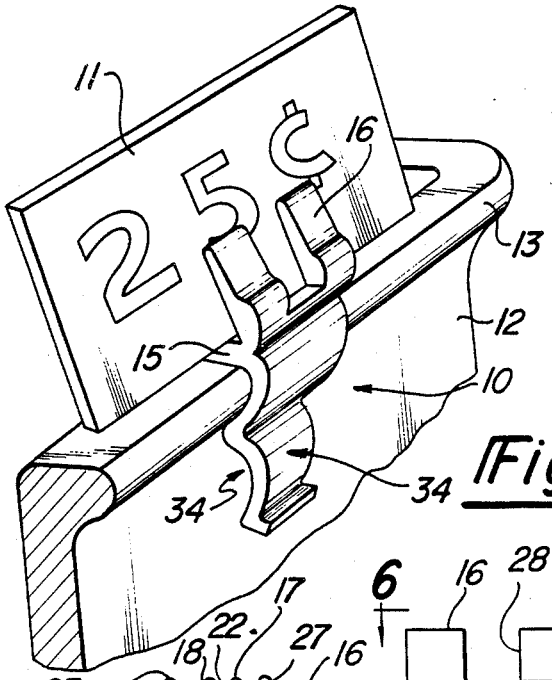
FIG. 1 is a perspective view of a clip mounting a price display card upon the upper edge of an open, bowl-like container.
Figure 2:
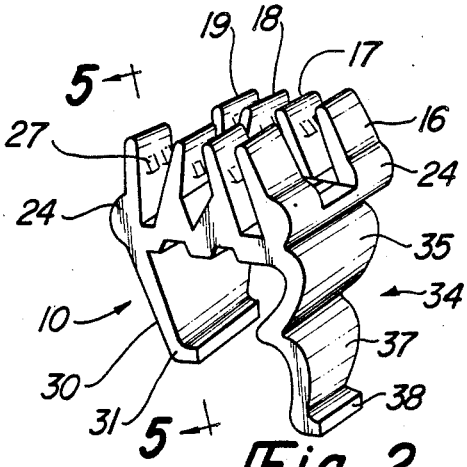
FIG. 2 is a perspective view of the clip.

Referring to FIG. 1 of the drawings, the clip 10 is arranged to mount a price display card 11, bearing printed indicia, such as the price of the goods, upon a bowl 12 having an outwardly extending lip 13. The size and shape of the bowl or other open top container may change considerably and likewise, the display card may be of different types. However, the clip is adapted to universally fit almost every type of bowl or container commonly used and to hold standard types of price display cards used in supermarkets and retail stores.

The clip is molded out of a suitable plastic material which is somewhat resilient. The particular kind of plastic material chosen depends upon availability, cost and resistance of the plastic to the environment in which it is used. That is, the plastic must be relatively inert with respect to acids and other food ingredients and must be easily cleaned for sanitary purposes. A number of different commercially available plastics may be used for this purposes.

Figure 3:
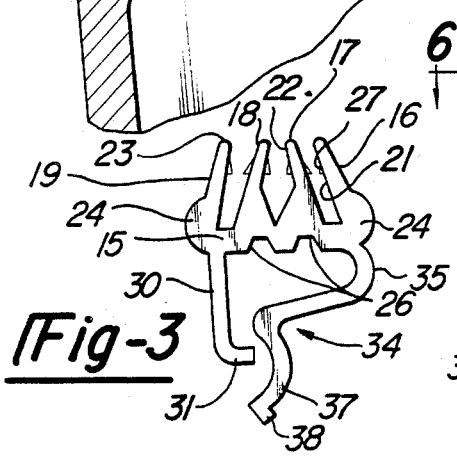
FIG. 3 is an elevational view of the end of a clip.

The clip includes an approximately horizontally arranged base 15 which is rectangular in shape. A number of legs, 16, 17, 18 and 19 are integral with the upper surface of the base and extend upwardly at different angles, as illustrated, for example in FIG. 3. The spaces between the legs form an outer card containing channel 21, a central card receiving channel 22 and an inner card receiving channel 23.

Preferably, bulges 24 are formed along the outer portions of the outer legs 16 and 19 for reinforcing them. In addition, grooves 26 are formed in the lower surface of the base 15. Also, teeth 27 are molded at suitable locations along the facing surfaces of the teeth for gripping a card placed within the channel between each pair of teeth.

Figure 6:
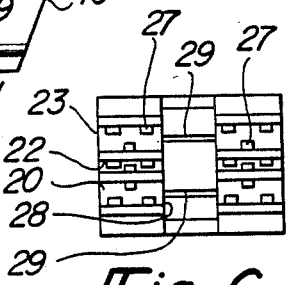
FIG. 6 is a top, plan view taken in the direction of arrows 6—6 of FIG. 4.

The clip may have its central portion cut away to divide each of the teeth into two parts with a space 28 between them. Further, slots 29 may be formed through the base 15 in the space 28 (see FIG. 6). The grooves 26 formed in the base 15 and slots 29 through the base, along with the space 28 between the teeth sections permits the plastic clip to flex somewhat and, also, to resiliently return to its molded shape.

The base has an inner, straight or approximately perpendicular leg 30 extending downwardly on one side and terminating in a flange 31. An outer, bent leg 34 is integrally formed on the opposite side of the base. This leg has a downwardly curved part 35 which continues in a roughly horizontally extending part 36, towards the straight leg 30, and then downwardly in a bowed or curved part 37 to terminate in a flange 28. The bowed part 37 is aligned with the flange 31 of the inner leg 30. (see FIG. 3)

Figure 4:
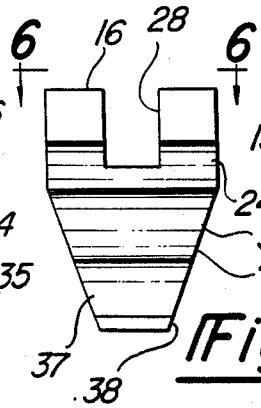
FIG. 4 is an elevational view of one face of the clip.
Figure 5:
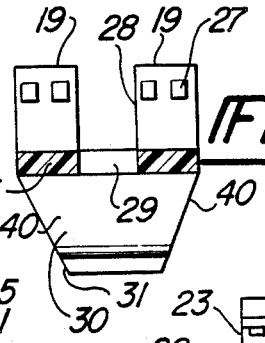
FIG. 5 is a cross-sectional view taken in the direction of arrows 5—5 of FIG. 2.

Preferably, the side edges 40 of the straight leg 30 are tapered towards each other (see FIG. 5). Likewise, the side edges 41 of the bent leg 34 are tapered toward each other (see FIG. 4). Thus, in the event that the legs extend into any food in the container, the legs diminish in size downwardly to minimize any contact with the food.

Figure 7:
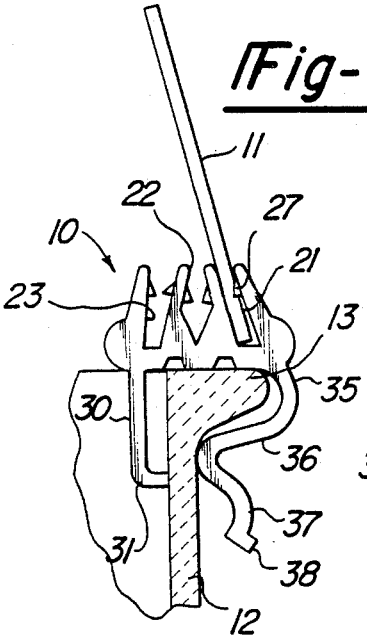
FIG. 7 illustrates the clip mounted upon a container having a lip formed on its upper edge, and shows the display card angularly mounted in one of the channels on the top of the clip.

In use, the clip is mounted upon the upper edge of the wall of a container such as a bowl. For example, FIG. 7, which is similar to FIG. 1, shows the clip extended over a lip 13 formed on the upper edge of a bowl-like container 12. In this case, the price display card is arranged within the outer channel 21 so that it tilts upwardly and rearwardly.

Figure 8:
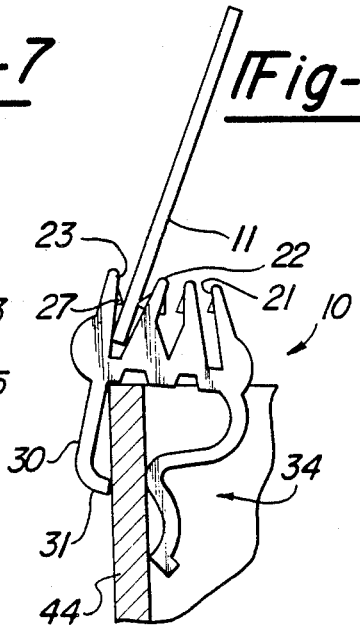
FIG. 8 is a view similar to FIG. 7, but showing the clip mounted upon a different kind of container wall edge and with the price display card mounted in a different upper channel for tilting at a different angle.

FIG. 8 illustrates another example where the clip is mounted upon the upper edge of a pan wall 44 which has no lip. The wall is gripped at three points, between the straight, leg flange 31, the edges of the bent leg bowed part 37. In this example, the price card is inserted in the inner card channel 23 where it is held in place by the teeth 27. Thus, the card is tilted at a different angle than that shown in FIG. 7.

Figure 9:
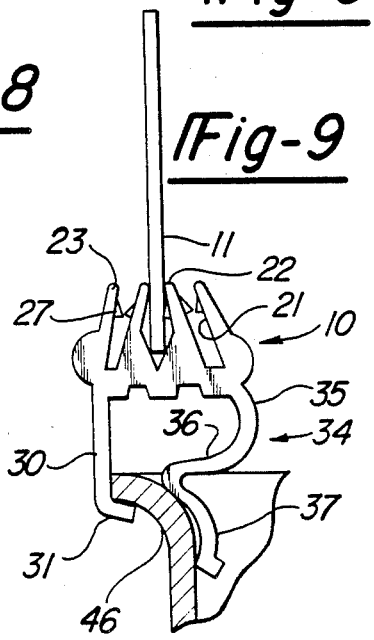
FIG. 9 shows the clip mounted upon a third kind of container wall edge and with the price display card mounted approximately vertically.

FIG. 9 shows a third illustration where the clip is mounted upon a bowl or container 47 having a curved upper edge 46. The upper edge is clamped between the bent leg bowed portion 37 and the straight leg flange 31. The price card is inserted in the central channel 22 so that it extends approximately vertically upright.

As can be seen, the clip may be mounted upon a wide variety of container edges and because of the shapes of the legs of the channel which receives the container edge, the clip can be mounted universally. Once forced over the top of the edge of a container wall, the clip has sufficient springiness to be tightly clamped in place. Removal requires exerting considerable pulling force. This is important in a supermarket display where price tags and clips are frequently pulled free from the displays by children or inadvertently knocked off their displays by careless persons.

This invention may be futher developed within the scope of the following claims. Hence, the foregoing description should be regarded an illustrative of an operative embodiment of this invention.

Having fully described an operative embodiment, I now claim:

1. A clip for mounting a small size, price display type card upon different shaped edges of the walls of open top containers such as bowls and the like, comprising:

a generally horizontally, rectangularly shaped base having a pair of integral, resilient legs extending downwardly from opposite edges to form a downwardly opening, edge receiving channel for fitting over the upper edge of a wall of an open top container;

two pairs of upwardly extending, generally parallel legs, integrally formed on the upper surface of the base, with the legs spaced closely to each other to form an upwardly opening card receiving channel between the legs of each pair of legs, and a third, central upwardly opening channel formed by the space between the two pairs of legs;

the adjacent surfaces of the two adjacent legs of each pair being sloped at an angle relative to the vertical to form angled, outermost card receiving channels that receive and hold the lower edges of cards with the cards tilted at an angle relative to the base, that is, tilted relative to vertical;

the central channel formed by the space between the two pairs of legs being about perpendicular to the base for holding the edge of a card about vertically;

whereby a card edge may be selectively inserted within one of the three card receiving channels for holding the card in a tilted or vertically directed position.

2. A clip as defined in claim 1 and including the outermost channels being tilted at different angles relative to the base.

3. A clip as defined in claim 1 and including said outermost channels being tilted upwardly towards each other so that they hold cards in oppositely tilted directions relative to the base.

4. A clip as defined in claim 3 and including integral teeth formed on at least some of the adjacent surfaces of said pairs of legs for gripping against the card surface.

5. A clip as defined in claim 1, and including one of the downwardly extending channel legs extending approximately perpendicularly to the base and forming an inner leg, and the other downwardly extending channel leg forming an outer leg extending downwardly a short distance and then being bent into a roughly horizontal portion extending closely towards the inner leg and thereafter, being bent into a downwardly extending portion for extending closely downwardly along side of the inner leg, whereby the outer leg may fit over and receive an outwardly extending container wall edge lip between the base and the outer leg horizontal portion, with the wall edge gripped between the inner leg and the outer leg downward portion.

6. A clip as defined in claim 5, and including the lower edge of the inner leg terminating in an integral flange extending towards the outer leg downward portion.

7. A clip as defined in claim 6, and including the downward portion being bowed into a curved shape which opens towards the inner leg and which is approximately centered on the lower edge of the inner leg.

8. A clip as defined in claim 7, and including each of the inner and outer legs having side edges which taper downwardly towards each other so that the lower edges of each of the inner and outer legs are considerably narrower than their upper edges, that is, where they are integral with the base.

9. A clip for mounting a small size, price display type card upon different shaped edges of walls of open top containers, such as bowls and the like, comprising:

a generally horizontal base having a substantial width and a pair of integral, resilient legs, extending downwardly from its opposite edges to form a downwardly opening edge receiving channel for fitting over the upper edge of a wall of an open top container;

means for enabling resilient bending of said base during movement of said legs, said means coupled with the bottom surface of said base and including parallel grooves formed in the lower surface of the base for providing narrowed lines in the base which enable the base to resiliently bend at said lines;

at least two upwardly extending legs formed integrally on the upper surface of the base and spaced closely to each other to form an upwardly opening card receiving channel within which the lower edge of a card may be inserted and frictionally held;

one of the downwardly extending legs being arranged generally perpendicularly to the base and forming an inner leg, and the other downwardly extending leg forming an outer leg which extends downwardly a short distance and then is bent into a roughly horizontal portion extending towards the inner leg and thereafter is bent into a downwardly extending portion along the side of the inner leg;

whereby the outer leg may fit over and receive an outwardly extending container wall edge lip between the base and the outer edge horizontal portion so that the wall edge may be gripped between the inner leg and outer leg.

10. A clip as defined in claim 9, and including the lower edge of the inner leg terminating in an integral flange extending towards the outer leg downward portion.

11. A clip as defined in claim 10, and including the outer leg downward portion being bowed into a curved shape which opens towards the inner leg and the flange and which is roughly centered relative to the lower edge of the inner leg.

12. A universal clip for mounting a price display type card upon different size and shape edges of the walls of open top container, comprising:

a generally horizontal base having a pair of integral, resilient legs extending downwardly from its opposite edges to form a downwardly opening edge receiving channel for fitting over the upper edge of a wall of an open top container;

a number of upwardly extending legs formed integrally upon the surface of the base, with the legs spaced closely to each other to form upwardly opening card receiving channels therebetween;

said upwardly opening channels being arranged at different angles relative to each other and to the base for gripping the lower edge of a card and holding the card at a plurality of different positions on said base and at a plurality of different angles relative to the base.

13. A clip as defined in claim 12 and including one of the downwardly extending legs being straight and the other being bent downwardly, then towards the straight leg and then downwardly along side of the straight leg;

whereby a lip of an upper edge of a container may be positioned between the legs, within the bent portions of the bent leg, and gripped between the legs for securing the clip upon the container edge.

14. A clip as defined in claim 13, and including the lower edge of the straight leg terminating in an integral flange extending towards the bent leg, and the downwardly extending portion of the bent leg being bowed into a curve, generally around the flange.

* * * * *

UNITED STATES PATENT AND TRADEMARK OFFICE

CERTIFICATE OF CORRECTION

PATENT NO. : 4,882,862

DATED : Nov. 28, 1989

INVENTOR(S) : Robert J. Slavsky, Sr.

It is certified that error appears in the above-identified patent and that said Letters Patent is hereby corrected as shown below:

In col. 3, line 33, after the word "flange", change "28" to --38--

In claim 12, col. 6, line 22, after the words "upon the", add --upper--

Signed and Sealed this

Nineteenth Day of February, 1991

*Attest:*

HARRY F. MANBECK, JR.

*Attesting Officer*

*Commissioner of Patents and Trademarks*